US007100556B2

(12) United States Patent
Sugiura

(10) Patent No.: US 7,100,556 B2
(45) Date of Patent: Sep. 5, 2006

(54) VARIABLE VALVE TIMING CONTROLLER

(75) Inventor: Taei Sugiura, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/326,349

(22) Filed: Jan. 6, 2006

(65) Prior Publication Data

US 2006/0162683 A1 Jul. 27, 2006

(30) Foreign Application Priority Data

Jan. 26, 2005 (JP) ..... 2005-018546

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 6,502,537 B1 * 1/2003 Todo et al. ..... 123/90.17
6,883,482 B1 4/2005 Takenaka et al.

FOREIGN PATENT DOCUMENTS

JP 2002-227616 8/2002

* cited by examiner

*Primary Examiner*—Thomas Denion
*Assistant Examiner*—Ching Chang
(74) *Attorney, Agent, or Firm*—Nixon & Vanderhye P. C.

(57) ABSTRACT

A variable valve timing controller has a phase adjusting mechanism. The phase adjusting mechanism includes a first rotating member and second rotating member which are respectively rotate in synchronization with a driving shaft and a driven shaft of an engine, a first arm rotatably connected with the first rotating member, and a second arm rotatably connected with the second rotating member and the first arm. In the first arm, a distance between connecting points is defined as a distance L1. In the second arm, a distance between connecting points is defined as a distance L2. A ratio L1/L2 is defined within a range of 0.5 to 2.

10 Claims, 13 Drawing Sheets

VARIABLE VALVE TIMING CONTROLLER

CROSS REFERENCE TO RELATED APPLICATIONS

This application is based on Japanese Patent Application No. 2005-018546 filed on Jan. 26, 2005, the disclosure of which is incorporated herein by reference.

FIELD OF THE INVENTION

The present invention relates to a variable valve timing controller which changes opening and closing timing of intake valves and/or exhaust valves of an internal combustion engine according to operating condition of the engine. The opening and closing timing is referred to as valve timing, the variable valve timing controller is referred to as the VVT controller, and the internal combustion engine is referred to as an engine hereinafter.

BACKGROUND OF THE INVENTION

The VVT controller is disposed in a torque transfer system which transfers the torque of the driving shaft of the engine to the driven shaft which opens and closes at least one of an intake valve or an exhaust valve. The VVT controller adjusts the valve timing of the valves by varying a rotational phase of the driven shaft to the driving shaft.

JP-2002-227616A shows a VVT controller having a sprocket which rotates in synchronism with the driving shaft, and a rotational phase adjusting mechanism which connects levers with the driven shaft via link arms. The phase adjusting mechanism converts a movement of the link arms into a relative rotational movement of the levers to the sprocket and varies the rotational phase of the driven shaft relative to the drive shaft.

In this conventional controller, guide balls held by the operation member are slidably engaged with a groove of the sprocket. When an engine torque is varied and some forces are applied to the phase adjusting mechanism, the operation member may slide in the groove so that the rotational phase of the driven shaft unnecessarily varies relative to the driving shaft.

U.S. Pat. No. 6,883,482B2, which is published on Apr. 26, 2005 and is not a prior art to the present invention, discloses a VVT controller in which a phase adjusting mechanism has a first arm connected with a sprocket through a revolute pair and a second arm connected with the first arm and the camshaft through revolute pairs. When some forces are applied to the arms, the arms tend to be bent in its width direction, so that durability of the VVT controller is deteriorated.

SUMMARY OF THE INVENTION

The present invention is made in view of the above matters, and it is an object of the present invention to provide the VVT controller which restricts rotational-phase fluctuations of the driven shaft if the force is applied to the phase adjusting mechanism, and has a high durability.

According to a VVT controller of the present invention, a revolute pair formed by a first arm and a first rotating member is defined as a first pair, a revolute pair formed by a second arm and a second rotating member is defined as a second pair, and a revolute pair formed by the first arm and the second arm is defined as a third pair. A distance between the first pair and the third pair is defined as a distance L1, a distance between the second pair and the third pair is defined as a distance L2. A ratio L1/L2 is established within a range of 0.5 to 2.

According to another aspect of the present invention, the third pair is arranged between the first pair and the second pair.

According to the other aspect of the present invention, in at least one of the first arm and the second arm, a phantom line connecting the first pair or the second pair with the third pair exists between both outer side peripheries of the first arm and/or the second arm in width direction thereof.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS

Embodiments of the present invention will be described hereinafter with reference to the drawings.

Figure 2:
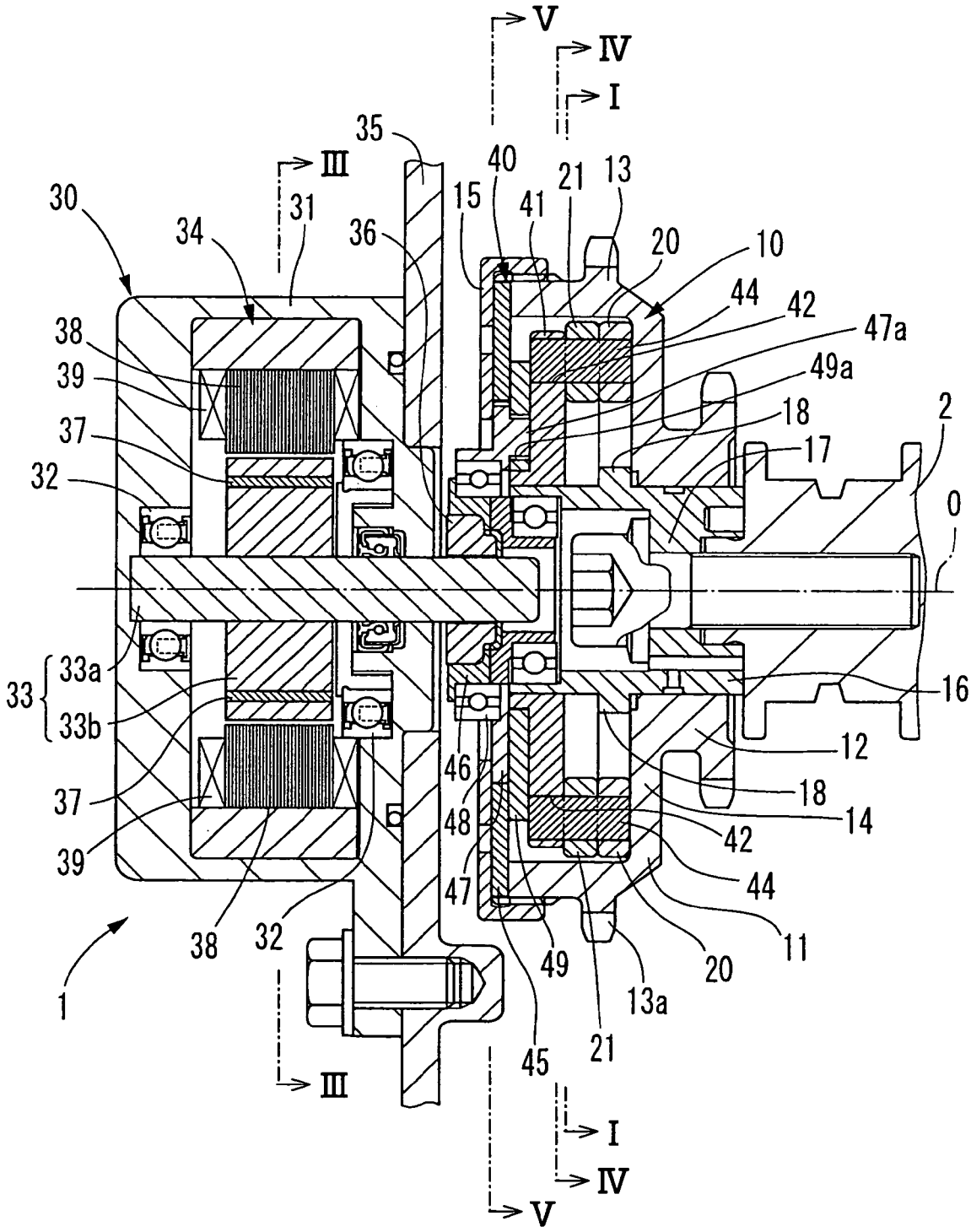
FIG. 2 is a cross sectional view taken along a line I—I of FIG. 1.
Figure 3:
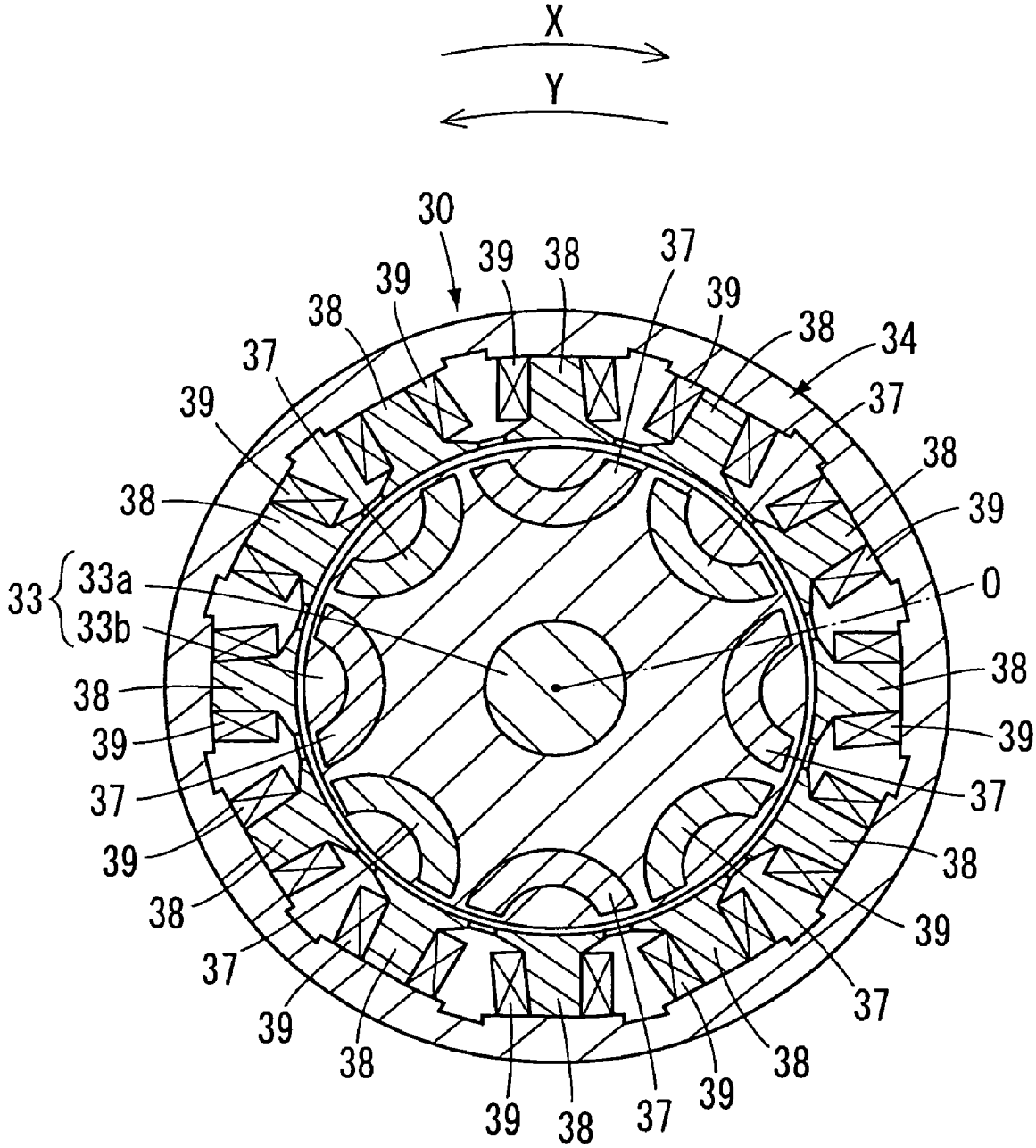
FIG. 3 is a cross sectional view taken along a line III—III of FIG. 2.

FIG. 2 shows a VVT controller 1 according to the first embodiment of the present invention. The VVT controller 1 is disposed in a torque transfer system which transfers the torque of a crankshaft (not shown) to a camshaft 2 which opens and closes at least one of an intake valve or an exhaust valve. The crankshaft is a driving shaft and the camshaft 2 is a driven shaft in this embodiment. The VVT controller 1 adjusts the valve timing of the intake valve or the exhaust valve by varying the rotational phase of the camshaft 2 relative to the crankshaft.

The VVT controller 1 has a phase adjusting mechanism 10, an electric motor 30, and a motion converting mechanism 40.

Figure 1:
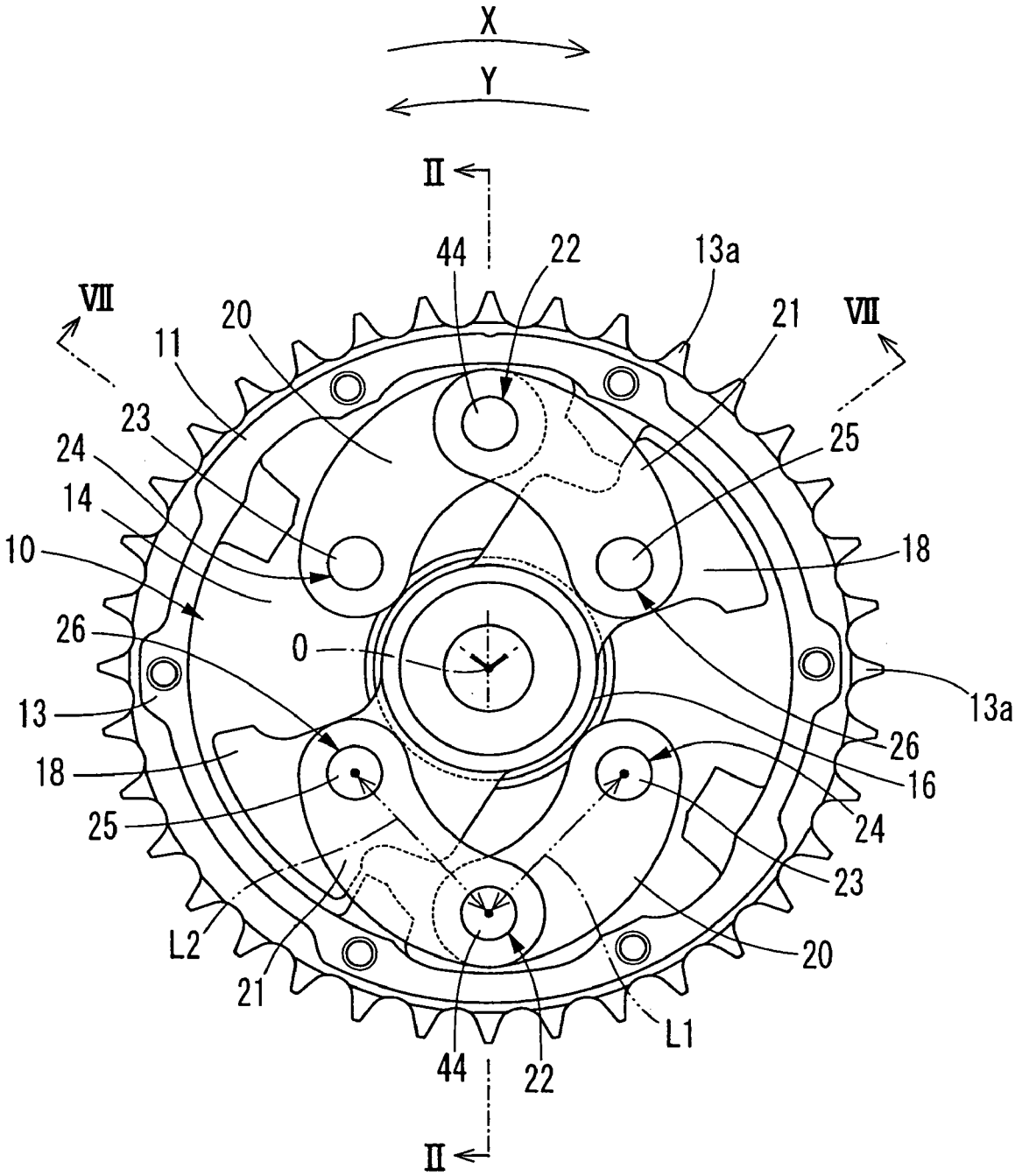
FIG. 1 is a cross sectional view of the VVT controller according to an embodiment of the present invention.
Figure 4:
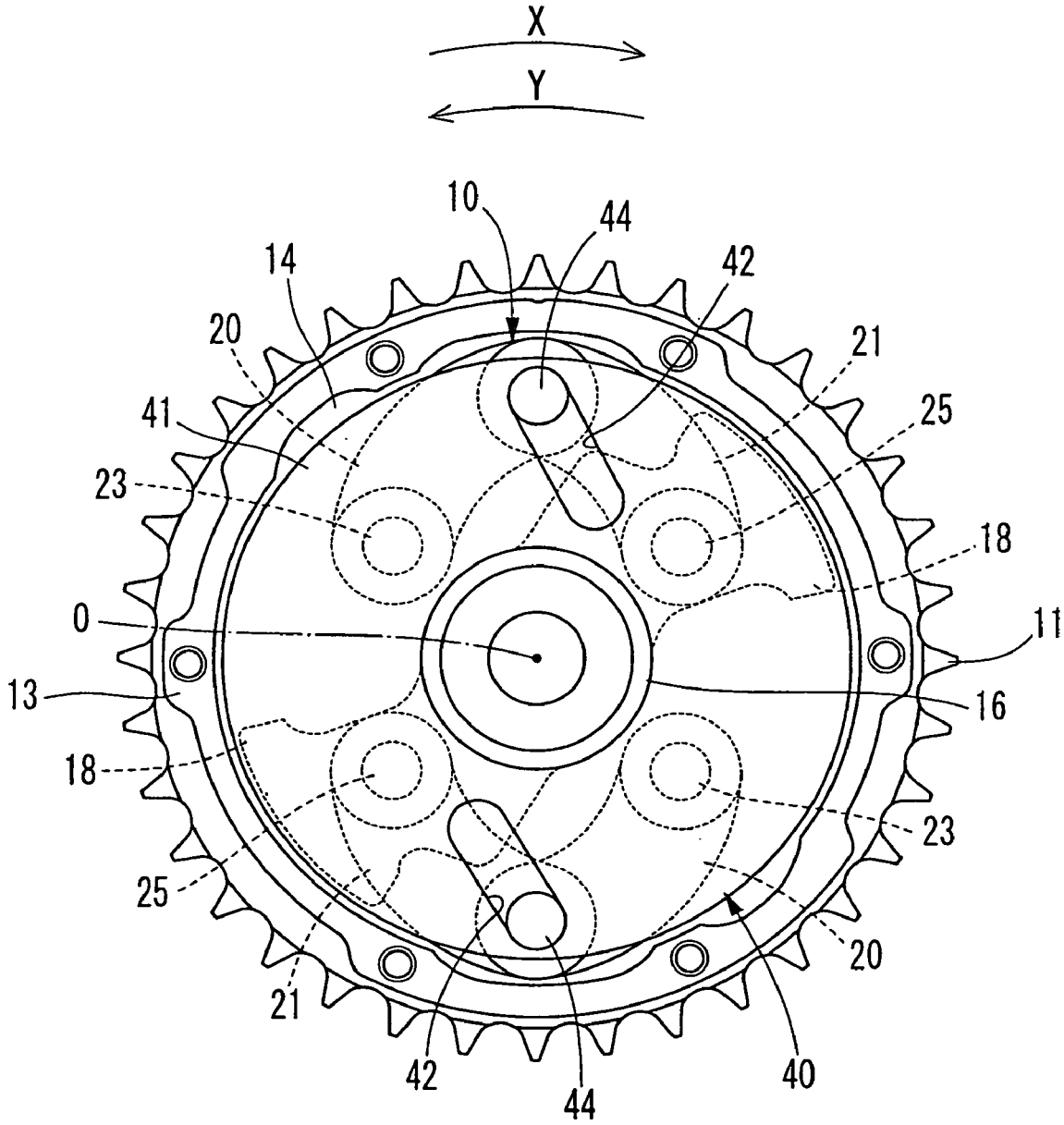
FIG. 4 is a cross sectional view taken along a line IV—IV of FIG. 2.
Figure 6:
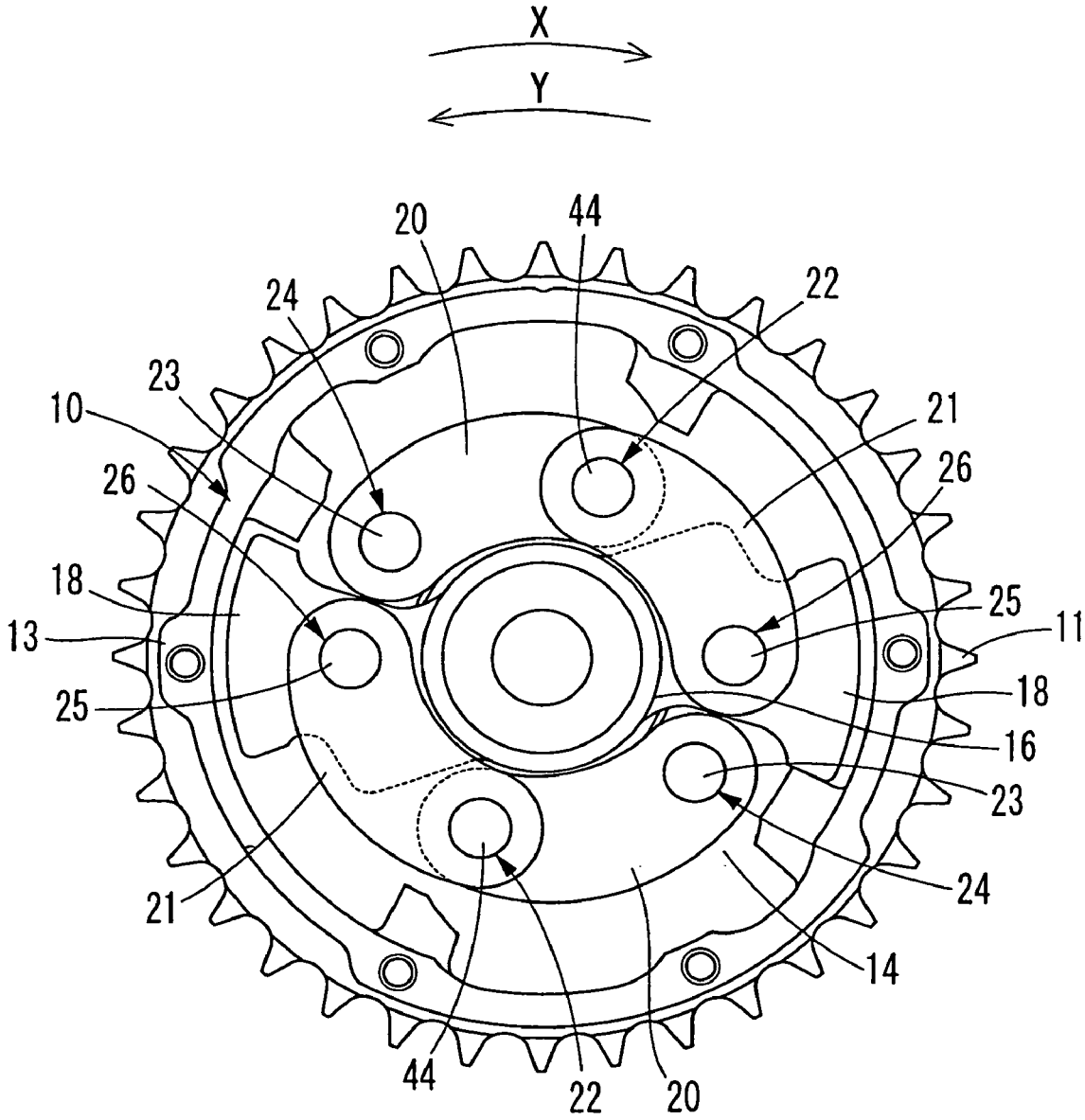
FIG. 6 is a cross sectional view corresponding to FIG. 1 for explaining an operation.
Figure 7:
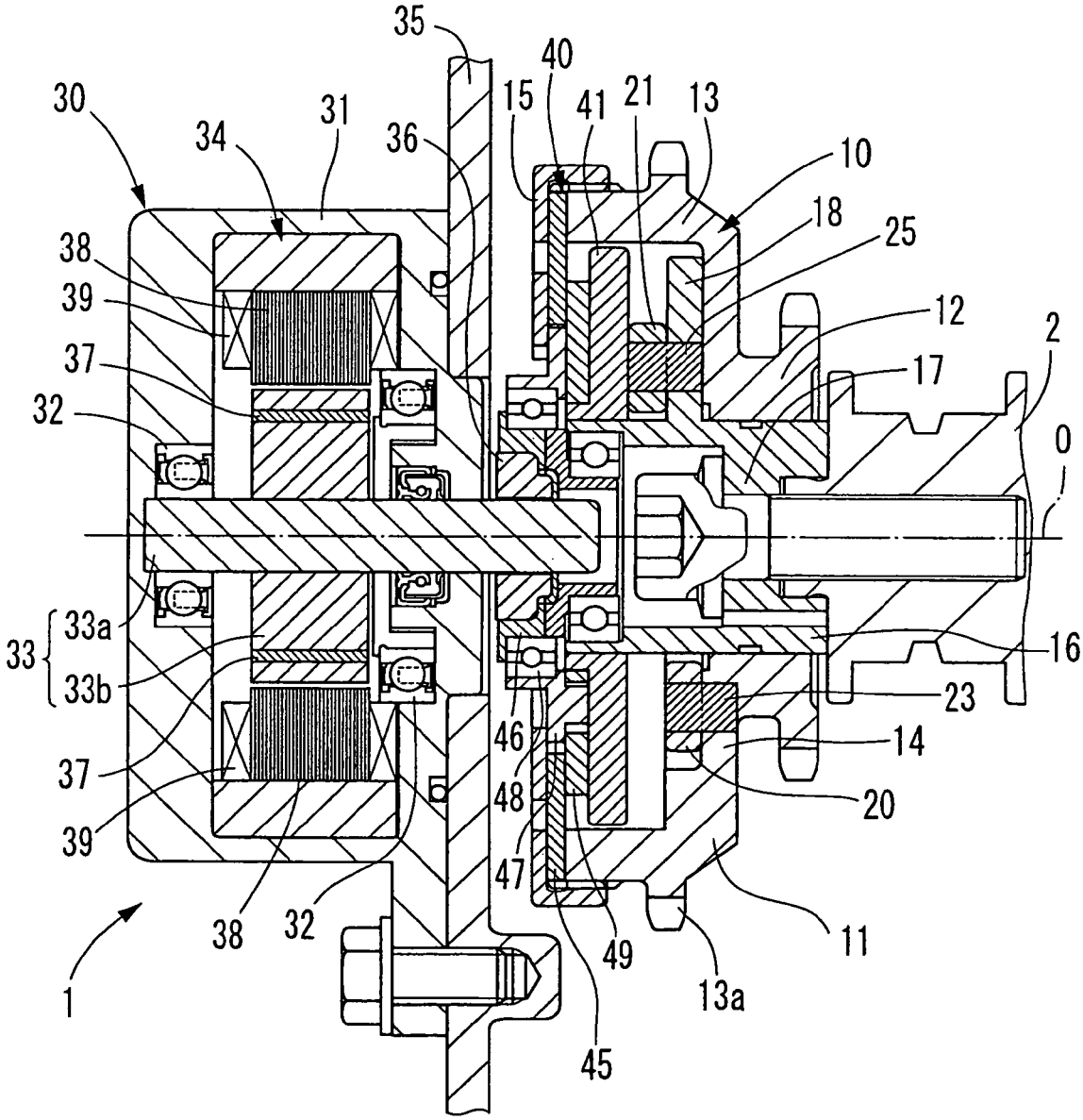
FIG. 7 is a cross sectional view taken along a line VII—VII of FIG. 1.

As shown in FIGS. 1 and 2, the phase adjusting mechanism 10 comprises a sprocket 11, an output shaft 16, a first arm 20, and a second arm 21 in order to adjust a relative rotational phase between the sprocket 11 and the output shaft 16, that is, a relative rotational phase between the crankshaft and the camshaft. In FIGS. 1, 4, and 6, hatching showing cross section is omitted.

The sprocket 11 has a supporting portion 12, an input portion 13 having a larger diameter than that of the supporting portion 12, and a first link portion 14 connecting the supporting portion 12 with the input portion 13. The supporting portion 12 is rotatively supported by the output shaft 16 around a center axis "O". A chain belt (not shown) runs over a plurality of gear tooth 13*a* formed on the input portion 13 and a plurality of gear tooth formed on the crankshaft. When the torque is transmitted from the crankshaft to the input portion 13 through a chain belt, the sprocket 11 rotates clockwise around the center axis "O", keeping the rotational phase unchanged relative to the crankshaft. The sprocket 11, which corresponds to a first rotational member, rotates in synchronism with the crankshaft.

The output shaft 16, which is the driven shaft, has a fixed portion 17 and a second link portion 18. One end of the camshaft 2 is concentrically coupled to the fixed portion 17 by a bolt, and the output shaft 16 rotates around the center axis "O", keeping the rotational phase to the camshaft 2. That is, the output shaft 16 corresponds to the second rotational member which rotates in synchronism with the camshaft 2.

The first and the second arm 20, 21 are sandwiched between a cover 15 and the first link portion 14 together with elements 41, 44, 45, 47, 49 of the motion converting mechanism 40. The cover 15 is fixed to the input portion 13. The first arm 20 is connected with the first link portion 14, forming a revolute pair therebetween. The second arm 21 is connected with the second link portion 18 and the first arm 20, forming revolute pairs respectively. Thereby, the output shaft 16 rotates in the same rotational direction as the sprocket 11. The output shaft 16 can rotate in an advance direction X and a retard direction Y relative to the sprocket 11. The first arm 20 and the second arm 21 are connected with a movable member 44 of the motion converting mechanism 40, forming revolute pairs respectively. Thereby, in the phase adjusting mechanism 10, a revolute pair 22 formed by the first arm 20 and the second arm 21 is connected with the movable member 44, so that the motion of the revolute pair 22 is converted into a relative rotational motion between the sprocket 11 and the output shaft 16.

The electric motor 30 is a brushless motor which includes a housing 31, bearings 32, a motor shaft 33, and a stator 34. The housing 31 is fixed on the engine by means of a stay 35. The housing accommodates two bearings 32 and the stator 34.

The motor shaft 33 is arranged on the same axis as the sprocket 11 and the output shaft 16, and is supported by the bearings 32. The motor shaft 33 is connected with the input shaft 46 of the motion converting mechanism 40 through a joint 36, so that the motor shaft 33 rotates around the center axis "O" with the input shaft 46. The motor shaft 33 has a shaft body 33*a* and a disk-shaped rotor 33*b*. Multiple magnets 37 are disposed in the rotor 33*b* near the outer periphery. The magnets 37 are made from rare-earth magnets and are disposed around the center axis "O" at regular intervals.

The stator 34 is located around the rotor 33*b*, and has a core 38 and a coil 39. The core 38 is formed by stacking a plurality of iron plates and protrudes toward the motor shaft 33. The core 38 has protrusions in same pitch, and the coil 39 is wound on each protrusions. The stator 34 generates a magnetic field around the motor shaft 33 based on the electric current supplied to the coil 39. The electric current is controlled by an electric circuit (not shown) in order to apply a torque to the motor shaft 33 in a delay direction Y or an advance direction X.

As shown in FIGS. 2 and 4, the motion converting mechanism 40 comprises a guide member 41, the movable member 44, a ring gear 45, the input shaft 46, a planetary gear 47, a bearing 48, and a transfer member 49.

The guide member 41 is a circular plate having the same axis as the output shaft 16, so that the guide member 41 can rotate around the center axis "O" in both directions X and Y relative to the sprocket 11. The guide member 41 is provided with two ellipse guide passages 42 which are arranged symmetrically to each other with respect to the center axis "O". Each guide passage 42 penetrates the guide member 41 in its thickness direction, and arranged point symmetrically by 180° with respect to the center axis "O". Each guide passage 42 is inclined relative to radial direction of the guide member 41 and linearly extends in such a manner that a distance from the center axis "O" varies.

The movable member 44 is provided in each of the guide passages 42. The movable member 44 is cylindrical-shaped and is sandwiched between the first link portion 14 and the transfer member 49 in such a manner as to be eccentric relative to the center axis "O". One end portion of the movable member 44 is respectively engaged with the corresponding guide passage 42, forming a revolute pair therebetween. The other end portion of the movable member 44 is engaged with the first and the second arm 20, 21, forming a revolute pair therebetween.

Figure 5:
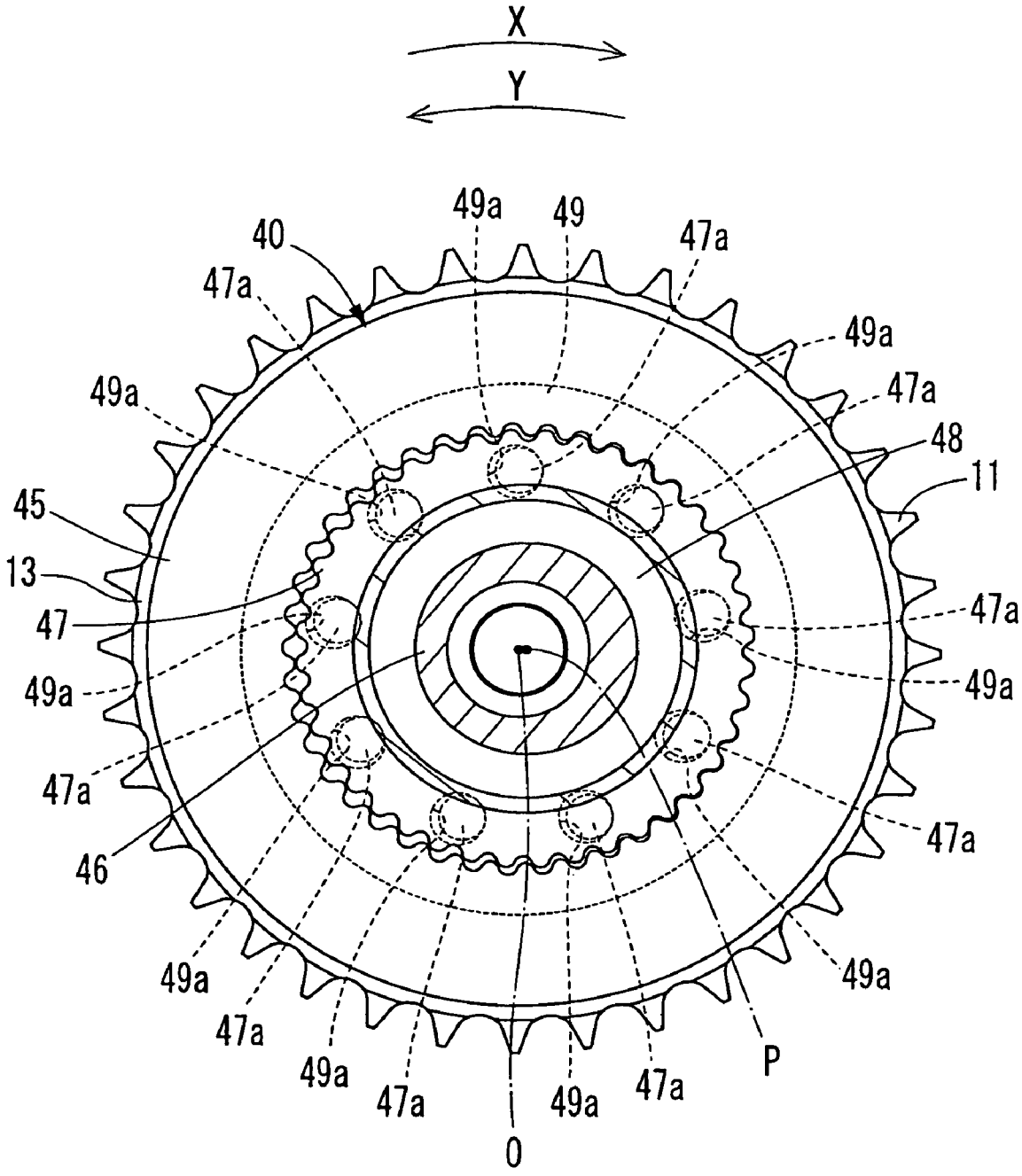
FIG. 5 is a cross sectional view taken along a line V—V of FIG. 2.

As shown in FIGS. 2 and 5, the ring gear 45 is an internal gear of which addendum circle is inside of a dedendum circle, and is coaxially fixed on inner wall of the input portion 13. The ring gear 45 can rotates around the center axis "O" with the sprocket 11.

The input shaft 46 is connected with the motor shaft 33 of the electric motor 30 in such a manner as to be eccentric with respect to the center axis "O". In FIG. 5, a point "P" represents a center point of the input shaft 46.

The planetary gear 47 is an external gear of which addendum circle is outside of a dedendum circle.

A curvature radius of the addendum circle of the planetary gear 47 is smaller than a curvature radius of the dedendum circle of the ring gear 45. The number of teeth of the planetary gear 47 is fewer than that of the ring gear 45 by one tooth. The planetary gear 47 is arranged inside of the ring gear 45 to be engaged with the ring gear 45. The planetary gear 47 is capable of conducting the sun-and-planet motion with the ring gear 45 as the sun gear. The input shaft 46 is engaged with an inner periphery of the planetary gear 47 through the bearing 48, so that the motor shaft 33 connected with the input shaft 46 is capable of rotating in the directions X, Y relative to the sprocket 11.

The transfer member 49 is a circular plate which is coaxial to the guide member 41 and is arranged opposite side of the arm 20, 21 across the guide member 41. The transfer member 49 is engaged with and fixed to the guide member 41, so that the transfer member 49 can rotate around the center axis "O" with the guide member 41 in the directions X, Y relative to the sprocket 11. The transfer member 49 is provided with a plurality of cylindrical engaging holes 49*a* which penetrate the transfer member 49 in its thickness direction. Each of the engaging holes 49*a* is around the center axis "O" at regular intervals. The planetary gear 47 is provided with a plurality of engaging protrusions 47*a* which are arranged around the center point "P" at regular intervals to be engaged with the engaging holes 49*a*.

When the motor shaft 33 does not rotate relative to the sprocket 11, the planetary gear 47 rotates with the sprocket 11 and the input shaft 46, engaging with the ring gear 45. The engaging protrusions 47*a* push the inner periphery of the engaging holes 49*a* toward the rotating direction, so that the transfer member 49 and the guide member 41 rotate, keeping the rotating phase relative to the sprocket 11. At this moment, each of the movable members 44 does not slide in the guide passages 42, and rotates with the guide member 41, keeping a distance from the center axis "O".

When the motor shaft 33 rotates in the retard direction Y relative to the sprocket 11, the planetary gear 47 rotates clockwise in FIG. 5 relative to the input shaft 46 to change the engaging position with the ring gear 45. Since pressing force in which the engaging protrusions 47*a* push the inner periphery of the engaging holes 49*a* in the rotating direction is increased, the transfer member 49 and the guide member 41 rotate in the advance direction X relative to the sprocket 11. At this moment, the movable members 44 slide in the guide passages 42 in such a manner as to be apart from the center axis "O".

When the motor shaft rotates in the advance direction X relative to the sprocket 11, the planetary gear 47 rotates anticlockwise in FIG. 5 relative to the input shaft 46 to change the engaging position. Since the engaging protrusions 47*a* push the inner periphery of the engaging holes 49*a* in the anti-direction of the rotating direction, the transfer member 49 and the guide member 41 rotate in the retard direction Y relative to the sprocket 11. At this moment, the movable members 44 slide in the guide passages 42 in such a manner as to be close to the center axis "O".

As described above, the motion converting mechanism 40 converts the rotating motion of the electric motor 30 into the sliding motion of the movable member 44. The electric motor 30 and the motion converting mechanism 40 correspond to a control means which controls the movement of the revolute pair 22. The revolute pair 22 includes the movable member 44.

Referring to FIGS. 1, 2, 6 and 7, a structure of the phase adjusting mechanism 10 is described hereinafter. FIG. 1 shows a situation where the output shaft 16 is most retarded relative to the sprocket 11, and FIG. 6 shows a situation where the output shaft 16 is most advanced relative to the sprocket 11.

In the phase adjusting mechanism 10, the first arm 20 is an arch-shaped plate which is respectively provided both sides across the center axis "O". The first link portion 14 is a circular plate which has the same axis as the output shaft 16. The first arm 20 is connected with the first link portion 14 at two positions across the center axis "O" through a first shaft member 23. The first shaft member 23 is a cylindrical column which is eccentric to the center axis "O". The first link portion 14 and the first arm 20 form a revolute pair 24, which is referred to as a first pair 24 hereinafter.

The second arm 21 is an arch-shaped plate which is respectively provided both sides across the center axis "O". The second link portion 18 comprises two plates which project in radial direction from the fixed portion 17. One end of the second arm 21 is connected with the second link portion 18 through a second shaft member 25. The second shaft member 25 is a cylindrical column which is eccentric to the center axis "O". The second link portion 18 and the second arm 21 form a revolute pair 26, which is referred to as a second pair 26 hereinafter. The Distances from the center axis "O" to each second pair 26 are equal to each other.

The other end of the first arm 20 and the other end of the second arm 21 are connected with each other through the movable member 44, whereby a revolute pair 22 is formed. The revolute pair 22 is referred to as a third pair 22 hereinafter.

In the phase adjusting mechanism 10, when the distance between the center axis "O" and the movable member 44 is constant, the positions of the first to third pairs 24, 26, 22 do not change. Keeping the rotational phase relative to the sprocket 11, the out put shaft 16 rotates with the camshaft 2 so that the rotational phase of the camshaft 2 relative to the crankshaft is kept constant.

When the distance between the center axis "O" and the movable member 44 is made longer, for example, when the phase adjusting mechanism 10 is varied from a mode shown in FIG. 6 to a mode shown in FIG. 1, the first arm 20 rotates around the first shaft member 23 and the movable member 44 relative to the fist link portion 14 and the second arm 21. At the same time, the second arm 21 rotates around the second shaft member 25 relative to the second link portion 18 so that the second pair 26 moves in the retard direction Y. Thus, the output shaft 16 rotates in the retard direction Y relative to the sprocket 11 in order to retard the rotational phase of the camshaft 22 relative to the crankshaft.

When the distance between the center axis "O" and the movable member 44 is made shorter, for example, when the phase adjusting mechanism 10 is varied from the mode shown in FIG. 1 to the mode shown in FIG. 6, the first arm 20 rotates around the first shaft member 23 and the movable member 44 relative to the fist link portion 14 and the second arm 21. At the same time, the second arm 21 rotates around the second shaft member 25 relative to the second link portion 18 so that the second pair 26 moves in the advance direction X. Thus, the output shaft 16 rotates in the advance direction X relative to the sprocket 11 in order to advance the rotational phase of the camshaft 22 relative to the crankshaft.

The structure of the phase adjusting mechanism 10 is described in detail hereinafter.

(First Feature)

Figure 8:
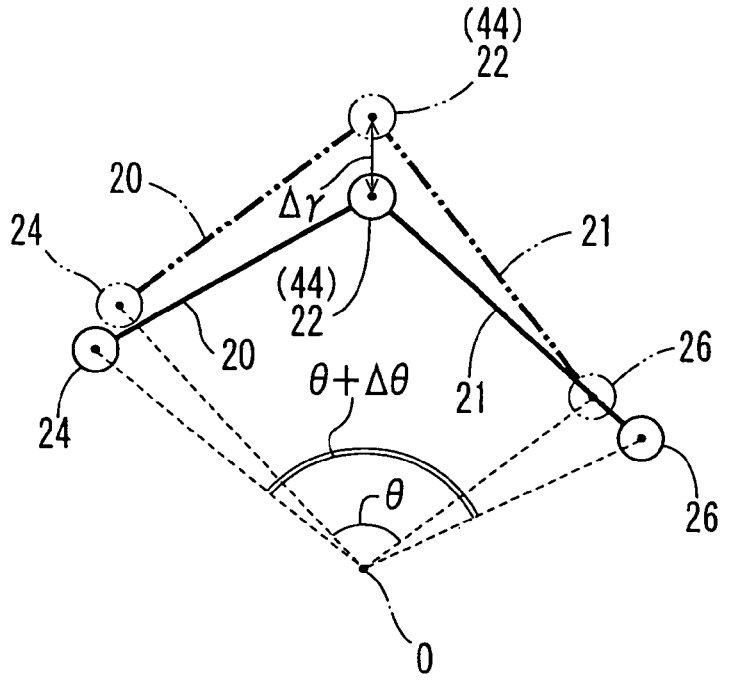
FIG. 8 is a schematic view for explaining a feature of the embodiment.

As shown in FIG. 8, a radial line connecting the first pair 24 and the center axis "O" and the other radial line connecting the second pair 26 and the center axis "O" form an angle $\theta$. When the position of the third pair 22 (the movable member 44) is moved by $\Delta r$, the angle $\theta$ is increased by $\Delta\theta$. The angle $\theta$ corresponds to a relative rotational phase between the sprocket 11 and the output shaft 16. The variation amount $\Delta\theta$ corresponds to the variation amount of the relative rotational phase with respect to the variation amount $\Delta r$ of the third pair 22. Thus, according as the variation amount $\Delta\theta$ per unit variation amount $\Delta r$ becomes smaller, the variation in the relative rotational phase between the sprocket 11 and the output shaft 16 becomes smaller.

Figure 9:
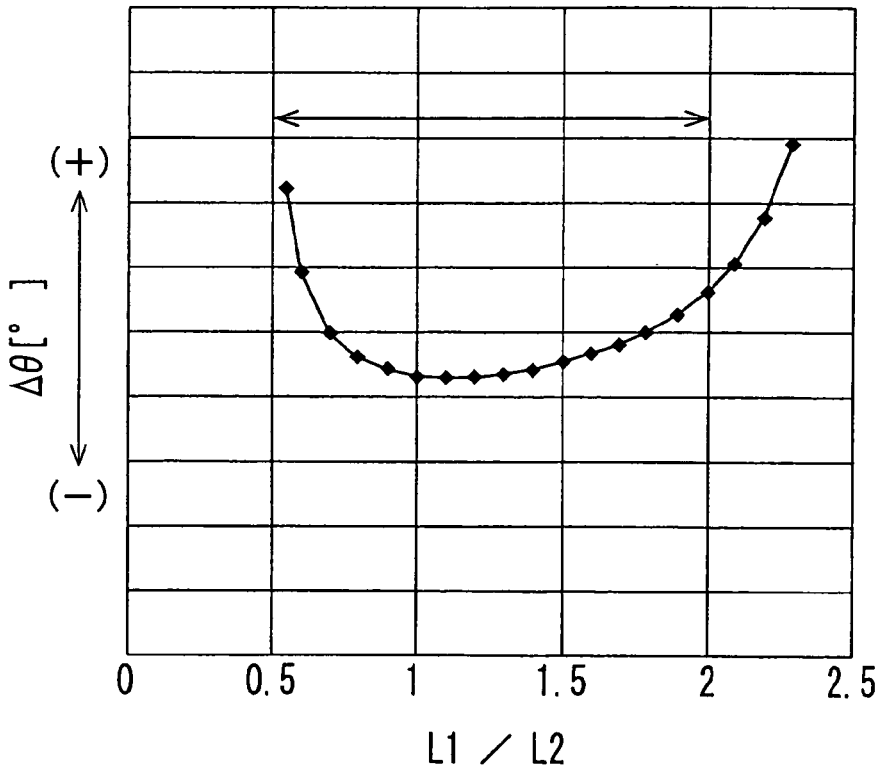
FIG. 9 is a graph showing characteristics for explaining the feature of the embodiment.

Under such knowledge, it becomes apparent that according as the difference in length between a distance L1 and a distance L2 becomes small, the variation amount $\Delta\theta$ per unit variation amount $\Delta r$ becomes small. The distance L1 represents a distance between the first pair 24 and the third pair 22 in the first arm 20, and the distance L2 represents a distance between the second pair 26 and the third pair 22 in the second arm 21. As shown in FIG. 9, in the case that the ratio between the distance L1 and the distance L2 is within 0.5–2, the variation amount $\Delta\theta$ is relatively small. In the present embodiment, the first arm 20 and the second arm 21 has substantially the same shape so that the ratio L1/L2 is determined as 1.

(Second Feature)

Figure 10:
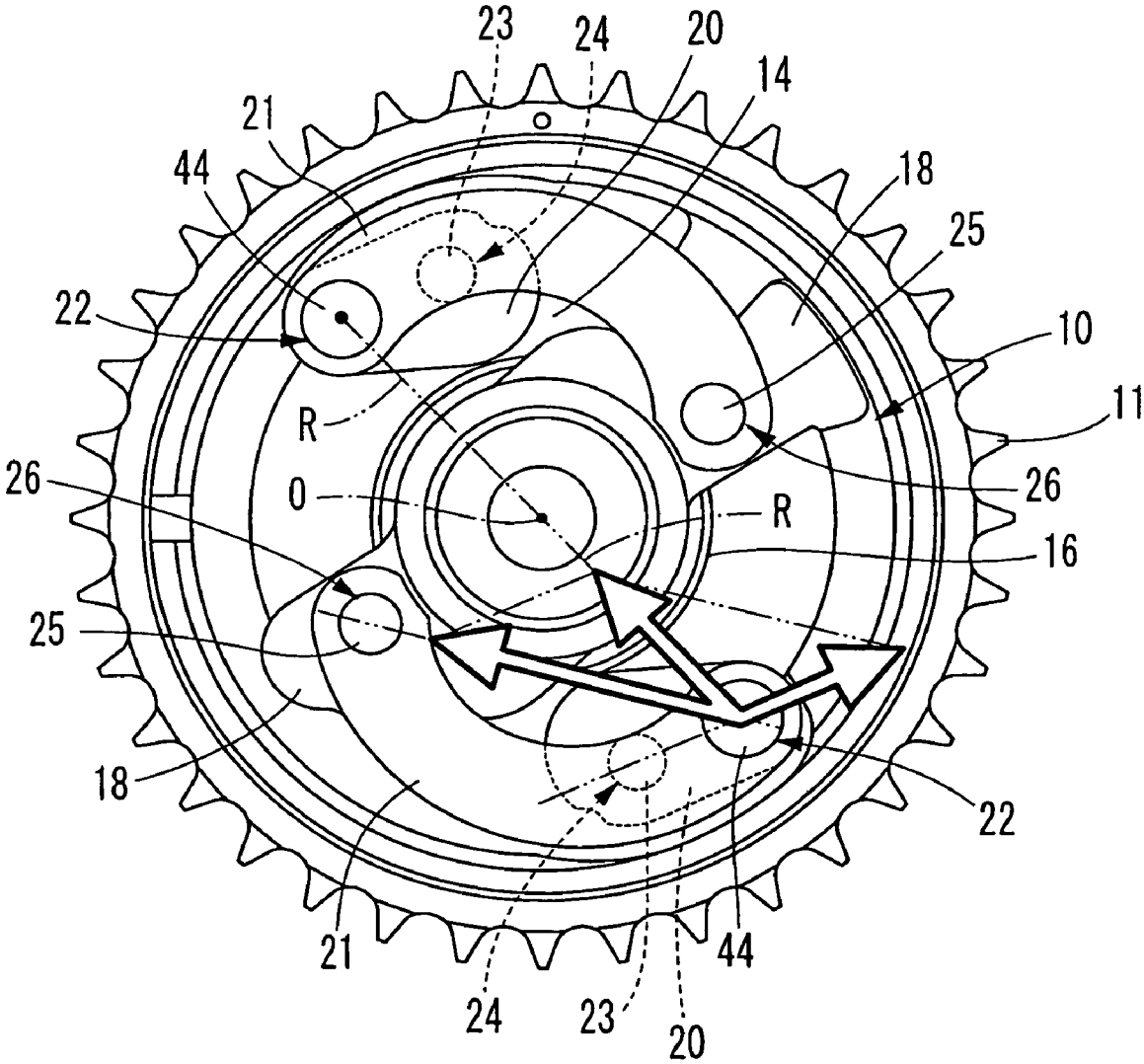
FIG. 10 is a cross sectional view of a comparative example.
Figure 11:
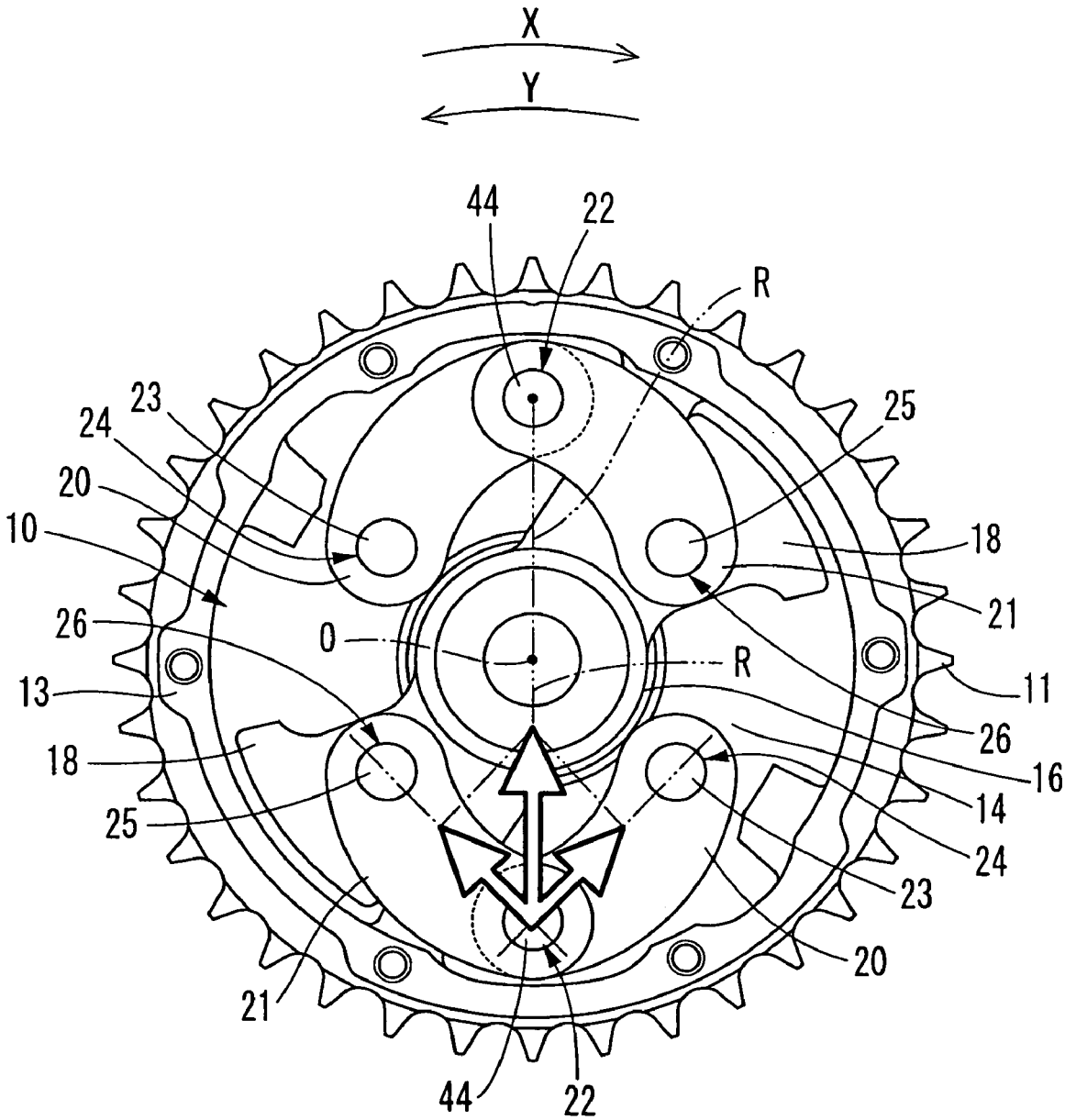
FIG. 11 is a cross sectional view for explaining the feature of the embodiment.

FIG. 10 shows a comparative example in which the first arm 20 and the second arm 21 are arranged in such a manner that the first pair 24 is positioned between the second pair 26 and the third pair 22. The force applied to the movable member 44 is divided along the first arm 20 and the second arm 21. Especially, the second arm 21 receives a large force. According to the inventor's study, when the third pair 22 is positioned between the first pair 24 and the second pair 26, the force applied to each arm 20, 21 becomes small. In the present embodiment, as shown in FIG. 11, the third pair 22 is poisoned between the first pair 24 and the second pair 26 so that the force applied to the movable member 44 is divided along the first arm 20 and the second arm 21, which are relatively small.

(Third Feature)

Figure 12:
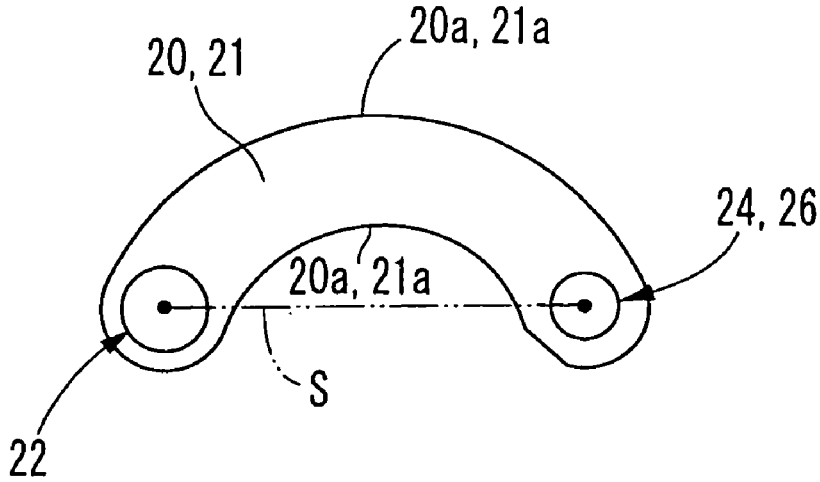
FIG. 12 is a plain view for explaining a comparative example.
Figure 13:
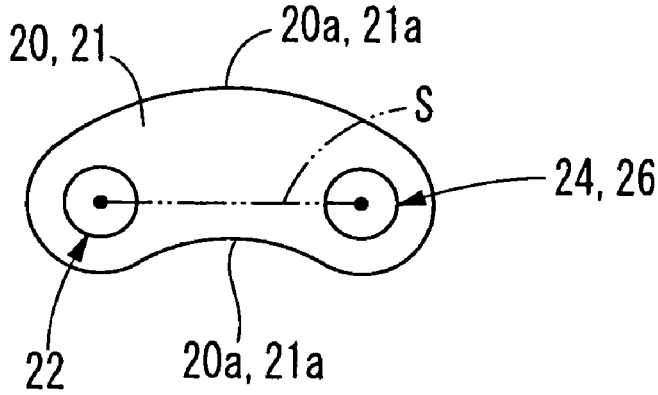
FIG. 13 is a plain view for explaining a feature of the embodiment.
Figure 14:
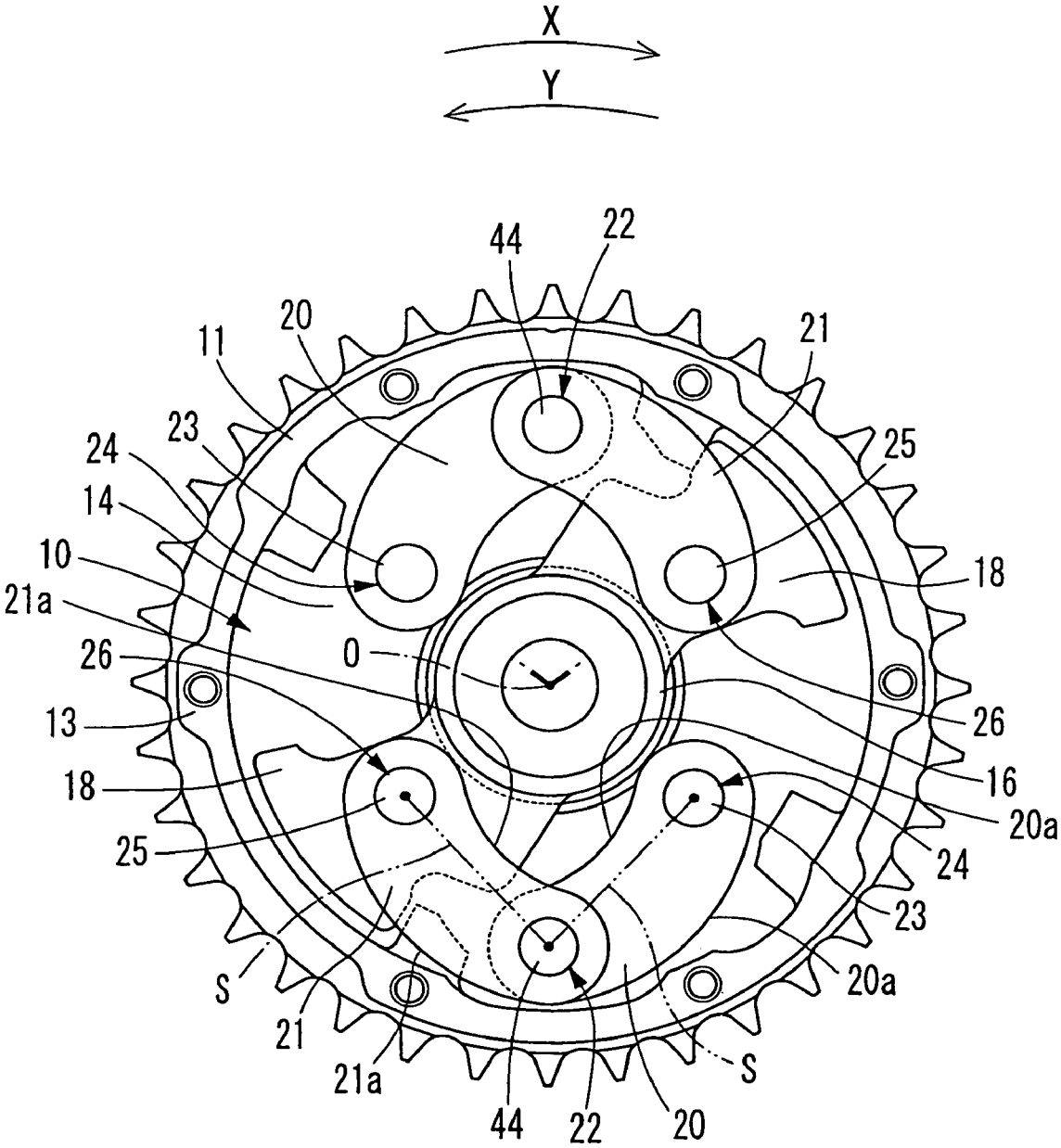
FIG. 14 is a cross sectional view for explaining a feature of the embodiment.

FIG. 12 shows a comparative example in which the first arm 20 and the second arm 21 are respectively curved in such a manner that a space exists on a line S connecting the first and second pairs 24, 26 with third pair 22. When a force is applied to the arms 20, 21 through the pairs 24, 26, 22, bending stress arises in the middle portion thereof along the outer periphery 20*a*, 21*a*. According to the inventor's study, in the case that the arms 20, 21 are formed in such a manner that the line S exists within the outer periphery 20*a*, 21*a* as shown in FIG. 13, the bending stress becomes small. In the present embodiment, the arms 20, 21 are respectively formed in such a manner that the line S exists within the outer periphery 20*a*, 21*a* as shown in FIG. 14.

According to the embodiment described above, the variation amount AO is small enough relative to the unit variation amount Δr, so that even if the position of the third pair 22 is varied due to the torque variation of the engine, the variation in the relative rotational phase between the sprocket 11 and the output shaft 16 is well restricted.

Furthermore, the force applied to the arms 20, 21 is reduced, so that the arms 20, 21 have high endurance.

(Modifications)

Figure 15:
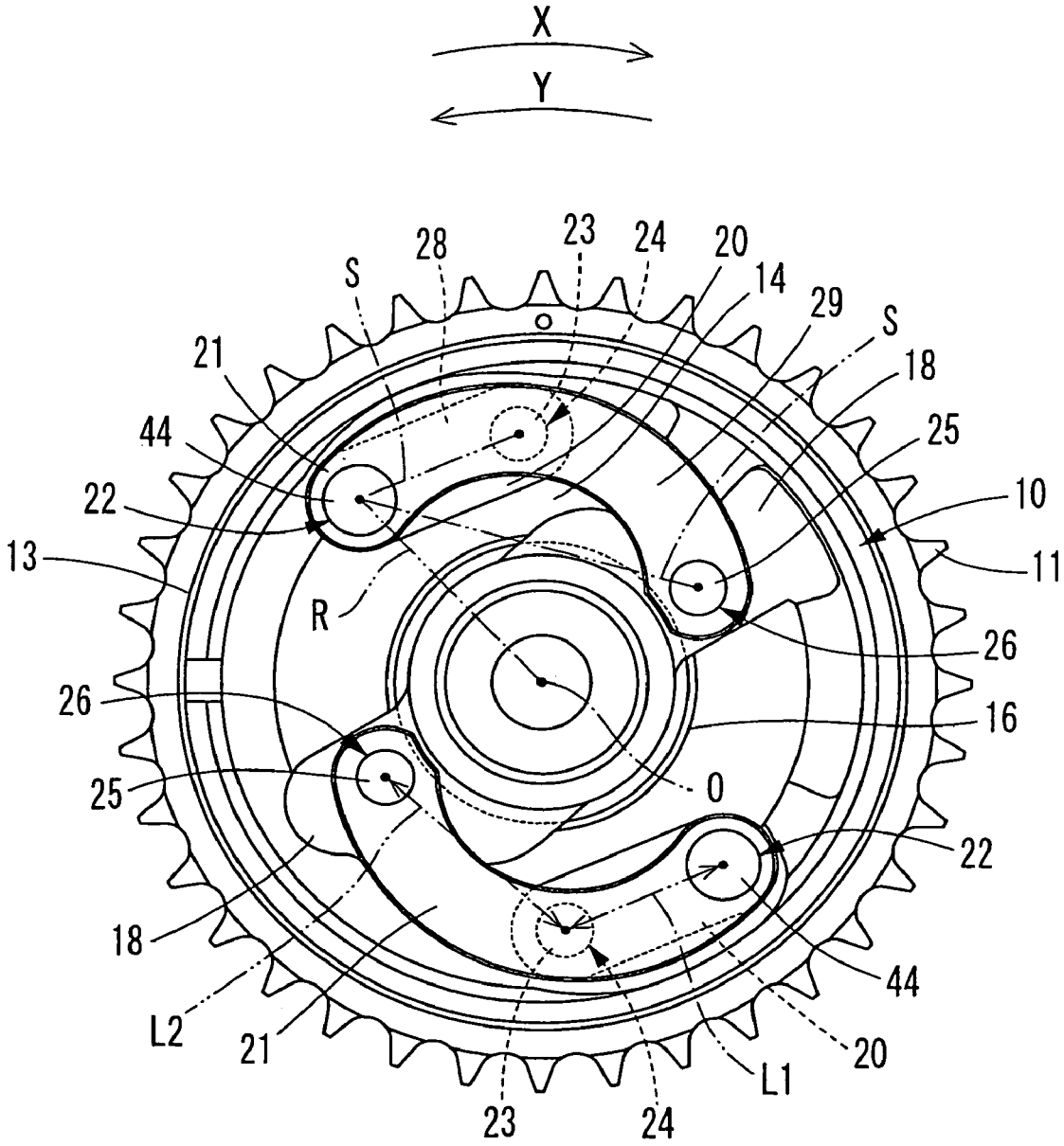
FIG. 15 is a cross sectional view of a modification of the embodiment.

The ratio L1/L2 can be determined other than 1 within the range of 0.5–2. Alternatively, in the case that the ratio L1/L2 is within the range of 0.5–2, the first pair 24 can be positioned between the second pair 26 and the third pair 22 as shown in FIG. 15. A space can be formed on the line S.

In the case that the third pair 22 is positioned between the first pair 24 and the second pair 26, the ratio L1/L2 is determined outside of the range of 0.5–2. At least one of the arms 20, 21 can be formed in such a manner that the space is formed on the line S.

In the case that the line S is within the outer periphery 20*a*, 21*a*, the ratio L1/L2 is determined outside of the range of 0.5–2. The first pair 24 can be positioned between the second pair 26 and the third pair 22.

The guide passage 42 can be arc-shaped, spiral-shaped, or polygonal curve. The number of the guide passage 42, the movable member 44, and the arms 20, 21 can be changed.

The electric motor 30 can be a brush motor or other type brushless motor. In the motion converting mechanism 40, the motor shaft 33 can be directly connected with the guide member 41.

What is claimed is:

1. A variable valve timing controller for an internal combustion engine, the variable valve timing controller being disposed in a system in which torque of a driving shaft is transmitted to a driven shaft adjusting an opening and closing timing of an intake valve and/or an exhaust valve, comprising:

a phase adjusting mechanism that includes a first rotating member rotating in synchronization with the driving shaft, a second rotating member rotating in synchronization with the driven shaft around a rotating center which is common to the first rotating member, a first arm pivoting on the first rotating member to form a revolute pair, and a second arm pivoting on the second rotating member and the first arm to form revolute pairs; and a control means adjusting the relative rotational phase between the first rotating member and the second rotating member by controlling a movement of the revolute pair formed by the first arm and the second arm wherein the revolute pair formed by the first arm and the first rotating member is defined as a first pair, the revolute pair formed by the second arm and the second rotating member is defined as a second pair, and the revolute pair formed by the first arm and the second arm is defined as a third pair, a distance between the first pair and the third pair is defined as a distance L1, a distance between the second pair and the third pair is defined as a distance L2, and a ratio L1/L2 is established within a range of 0.5 to 2.

2. A variable valve timing controller according to claim 1, wherein the ratio L1/L2 is approximately 1.

3. A variable valve timing controller according to claim 1, wherein the control means includes an electric motor and a motion converting mechanism which converts a rotational movement of the electric motor into a movement of the third pair.

4. A variable valve timing controller for an internal combustion engine, the variable valve timing controller being disposed in a system in which torque of a driving shaft is transmitted to a driven shaft adjusting an opening and closing timing of an intake valve and/or an exhaust valve, comprising:

a phase adjusting mechanism that includes a first rotating member rotating in synchronization with the driving shaft, a second rotating member rotating in synchronization with the driven shaft around a rotating center which is common to the first rotating member, a first arm pivoting on the first rotating member to form a revolute pair, and a second arm pivoting on the second rotating member and the first arm to form revolute pairs; and a control means adjusting the relative rotational phase between the first rotating member and the second rotating member by controlling a movement of the revolute pair formed by the first arm and the second arm wherein the revolute pair formed by the first arm and the first rotating member is defined as a first pair, the revolute pair formed by the second arm and the second rotating member is defined as a second pair, and the revolute pair formed by the first arm and the second arm is defined as a third pair, the third pair is arranged between the first pair and the second pair.

5. A variable valve timing controller according to claim 4, wherein a distance between the first pair and the third pair is defined as a distance L1, a distance between the second pair and the third pair is defined as a distance L2, and a ratio L1/L2 is established within a range of 0.5 to 2.

6. A variable valve timing controller according to claim 5, wherein the ratio L1/L2 is approximately 1.

7. A variable valve timing controller according to claim 4, wherein the control means includes an electric motor and a motion converting mechanism which converts a rotational movement of the electric motor into a movement of the third pair.

8. A variable valve timing controller for an internal combustion engine, the variable valve timing controller being disposed in a system in which torque of a driving shaft is transmitted to a driven shaft adjusting an opening and closing timing of an intake valve and/or an exhaust valve, comprising:

a phase adjusting mechanism that includes a first rotating member rotating in synchronization with the driving shaft, a second rotating member rotating in synchronization with the driven shaft around a rotating center which is common to the first rotating member, a first arm pivoting on the first rotating member to form a revolute pair, and a second arm pivoting on the second rotating member and the first arm to form revolute pairs; and a control means adjusting the relative rotational phase between the first rotating member and the second rotating member by controlling a movement of the revolute pair formed by the first arm and the second arm wherein the revolute pair formed by the first arm and the first rotating member is defined as a first pair, the revolute pair formed by the second arm and the second rotating member is defined as a second pair, and the revolute pair formed by the first arm and the second arm is defined as a third pair, in at least one of the first arm and the second arm, a phantom line connecting the first pair or the second pair with the third pair exists between both outer side peripheries of the first arm and/or the second arm in width direction thereof.

9. A variable valve timing controller according to claim 8, wherein at least one of the first arm and the second arm has a solid portion along the whole of the phantom line.

10. A variable valve timing controller according to claim 9, wherein the control means includes an electric motor and a motion converting mechanism which converts a rotational movement of the electric motor into a movement of the third pair.

* * * * *

UNITED STATES PATENT AND TRADEMARK OFFICE

CERTIFICATE OF CORRECTION

PATENT NO. : 7,100,556 B2
APPLICATION NO. : 11/326349
DATED : September 5, 2006
INVENTOR(S) : Sugiura It is certified that error appears in the above-identified patent and that said Letters Patent is hereby corrected as shown below:

On the Title Page:

Item "(75) Inventor: Taei Sugiura, Anjo (JP)"

should be

Item --(75) Inventors: Taei Sugiura, Anjo (JP); Yoshihito Moriya, Toyota (JP); Takashi Inoue, Toyota (JP); Koichi Shimizu, Toyota (JP)--

Signed and Sealed this

Eleventh Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,100,556 B2
APPLICATION NO. : 11/326349
DATED : September 5, 2006
INVENTOR(S) : Sugiura It is certified that error appears in the above-identified patent and that said Letters Patent is hereby corrected as shown below:

On the Title Page item

"(73) Assignee: Denso Corporation, Kariya (JP)"

should be

"(73) Assignees: Denso Corporation, Kariya (JP) and Toyota Jidosha Kabushiki Kaisha, Toyota-city (JP)"

Signed and Sealed this

Thirtieth Day of March, 2010

David J. Kappos

David J. Kappos
*Director of the United States Patent and Trademark Office*